US006398617B1

(12) United States Patent
Nelson

(10) Patent No.: US 6,398,617 B1
(45) Date of Patent: Jun. 4, 2002

(54) TOY FIGURE HAVING MARBLE RETAINING FEATURES

(76) Inventor: Webb Nelson, 19180 144th Ave. NE., Woodinville, WA (US) 98072

( * ) Notice: Subject to any disclaimer, the term of this patent is extended or adjusted under 35 U.S.C. 154(b) by 0 days.

(21) Appl. No.: 09/634,536

(22) Filed: Aug. 8, 2000

(51) Int. Cl.[7] ..... A63H 3/16
(52) U.S. Cl. ..... 446/268; 446/97
(58) Field of Search ..... 362/357; 446/97, 446/268, 321, 385, 389, 391, 392

(56) References Cited

U.S. PATENT DOCUMENTS 1,413,520 A * 4/1922 Darling ..... 362/357 X
2,477,460 A * 7/1949 Larson ..... 446/392
2,520,491 A * 8/1950 Bunin ..... 446/389 X
2,688,814 A * 9/1954 Irelan ..... 446/392 X
2,846,809 A * 8/1958 Majewski ..... 446/97 X

* cited by examiner

*Primary Examiner*—John A. Ricci
(74) *Attorney, Agent, or Firm*—LaMorte & Associates

(57) ABSTRACT

A toy figure assembly having a body section, limb sections and a head section. The head section is comprised of a pair of diverging loop structures sized and oriented to retain a marble or other spherical device. The loop structures support the marble in position as a visible part of a head to the figure. The loop structure also enables the marble to be grasped by a person's hand and shot out of the figure when playing the game of marbles. The loop structures used on the head of the figure can also be used as terminations to the limbs of the figure. Consequently, a toy figure is produced that retains at least one marble in a highly visible manner and in a position where the marbles can be readily removed or shot from the figure.

17 Claims, 4 Drawing Sheets

TOY FIGURE HAVING MARBLE RETAINING FEATURES

BACKGROUND OF THE INVENTION

1. Field of the Invention

In general, the present invention relates to posable toy figures of the type having a wire frame around which elastomeric material is molded. More particularly, the present invention is related to posable toy figures having uniquely formed head and hand features, that enables the toy figures to support secondary objects.

2. Description of the Prior Art

Toy figures, in the form of dolls, have been in existence many hundreds of years. In that time, dolls have been manufactured in most every conceivable style and shape. There now exists a wide range of different types of dolls and toy figures. One branch of toy figures within that wide range are the wire framed posable figures. Wire framed posable figures contain an internal wire frame that can be manually bent. Elastomeric material is then molded around the wire frame in the shape of a figure. The wire frame provides the elastomeric material with rigidity and enables the toy figure to be posed in different orientations.

Over the years, wire framed posable figures have been molded into a countless number of characters. Often, the characters have a visually identifiable head, such as Mickey Mouse, Gumby, Superman or the like. The feet of the figure are typically flat, thereby enabling the figure to be self-standing. The hands of the figure often are flat and are not capable of articulation. In some instances, the hands of the figure are formed into a C-shape, so that the figure can hold a prop, such as a sword or the like.

The present invention alters the traditional design of wire framed posable figures. With the present invention, the posable figure has no identifiable head. Rather, the head of the posable figure is a detachable marble. The wire framed posable figure is designed to retain a marble as the head of the figure and, in some instances, marbles as the hands of the figure. The marbles are retained in such a manner so that the marbles can be shot directly from the figures when playing the game of marbles. The unique features of the present invention are described and claimed below.

SUMMARY OF THE INVENTION

The present invention is a toy figure assembly. The toy figure has a body section, limb sections and a head section. The head section is comprised of a pair of diverging loop structures sized and oriented to retain a marble or other spherical device. The loop structures support the marble in position as a visible part of a head to the figure. The loop structure also enables the marble to be grasped by a person's hand and shot out of the figure when playing the game of marbles.

The loop structures used on the head of the figure can also be used as terminations to the limbs of the figure. Consequently, a toy figure is produced that retains at least one marble in a highly visible manner and in a position where the marbles can be readily removed or shot from the figure.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention toy figure can be configured into most any shape, such as that of an animal, a vehicle or the like, it is especially well suited to be configured as a humanoid figure. Consequently, the first embodiment of the present invention toy figure will be embodied as a humanoid figure in order to set forth the best embodiment contemplated.

Figure 1:
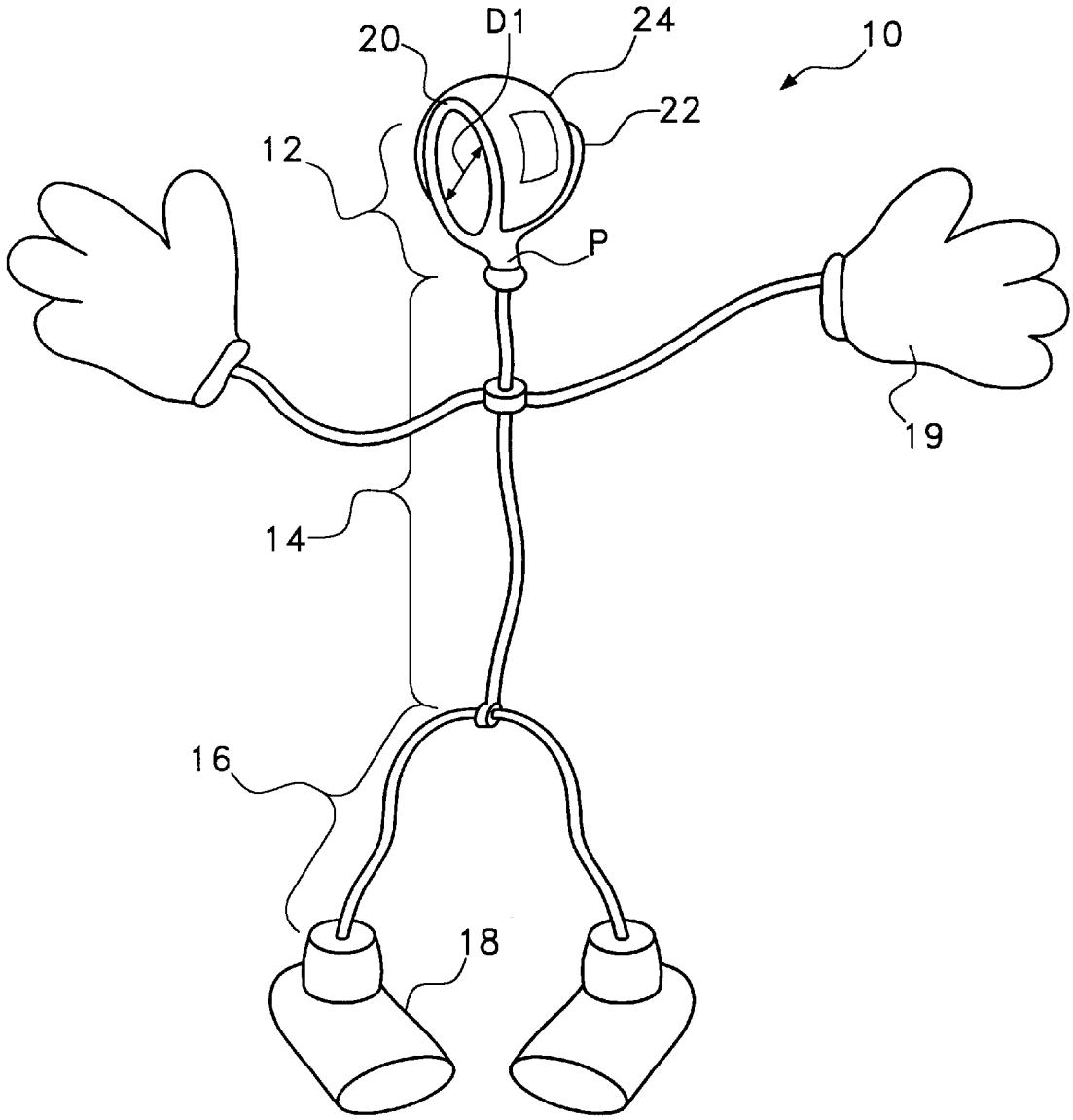
FIG. 1 is a front view of an exemplary embodiment of a toy figure in accordance with the present invention.

Referring to FIG. 1, a first embodiment of the present invention toy FIG. 10 is shown. The toy figure has a body section 14, limb sections 16 and a head section 12. In the shown embodiment, the body section 14, limb sections 16 and head section 12 are made of wire. The wire can be coated with a thin layer of elastomeric or plastic material. In alternate embodiments, elastomeric material can be molded around the body section 14 and limb sections 16, thereby providing the toy figure with an more anatomically correct shape. The wire used in the manufacture of the toy FIG. 10 preferably has ferro-magnetic properties for reasons that will later be explained.

In the shown illustration, enlarged feet 18 and hands 19 are joined to the limb sections 16 of the toy FIG. 10. The enlarged feet 18 provide the toy FIG. 10 with the ability to be self-standing. The enlarged hands 19 are for aesthetic purposes only and are used to visually balance the appearance of the enlarged feet 18. Within the enlarged hands 19 and feet 18 are disposed magnets. As such, the hands 19 and feet 18 will magnetically adhere to ferro-magnetic metals and other magnets. The strength of the magnets is preferably sufficient enough to support the weight of the overall toy FIG. 10. As such, the toy figure can hang from a ferro-magnetic surface with only one hand or one foot.

The head section 12 of the toy FIG. 10 is unique. The head section 12 of the toy FIG. 10 is comprised of two loop structures 20, 22 that join together at a common point P. The loop structures 20, 22 are made of wire that may be coated with elastomeric or plastic material. The common point P where the two loop structure join is also the point where the two loop structures 20, 22 attach to the body section 14 of the toy FIG. 10. Both loop structures 20, 22 define loops having an inner diameter D1. The two loop structures 20, 22 diverge away from the common point P of connection. As a result, a constantly widening gap exists between the two loop structures 20, 22 as the loop structures extend from the common point P of connection.

A marble 24 is provided. The marble 24 serves as the head to the toy FIG. 10. The marble 24 has a diameter that is larger than the inner diameter D1 of the loop structures 20, 22. As such, the marble 24 is not capable of passing through the center of the loop structures. The marble 24 fits into the gap that exists between the two loop structures 20, 22. The bottom of the marble 24 rests upon the common point P of connection between the two loop structures 20, 22 and the body section 14 of the toy FIG. 10. The loop structures 20, 22 extend around opposite sides of the marble 24. However, the loop structures 20, 22 do not pass over the top of the marble 24. Rather, the loop structures 20, 22 are sized in relation to the marble 24 to just retain the marble 24 in place. Accordingly, the toy FIG. 10 with the marble 24 in place may be moved without the marble 24 falling out from between the two looped structures 20, 22.

When the marble 24 is retained between the two looped structures 20, 24 of the toy FIG. 10, the marble takes the appearance as the head of the toy FIG. 10. The looped structures 20, 22 only pass along the sides of the marble 24. The marble 24 is visible through the loops of the looped structures 20, 22 and through the gap between the looped structures 20, 22. As such, a majority of the marble 24 remains visible when the marble 24 is retained by the two looped structures 20, 22.

Figure 2:
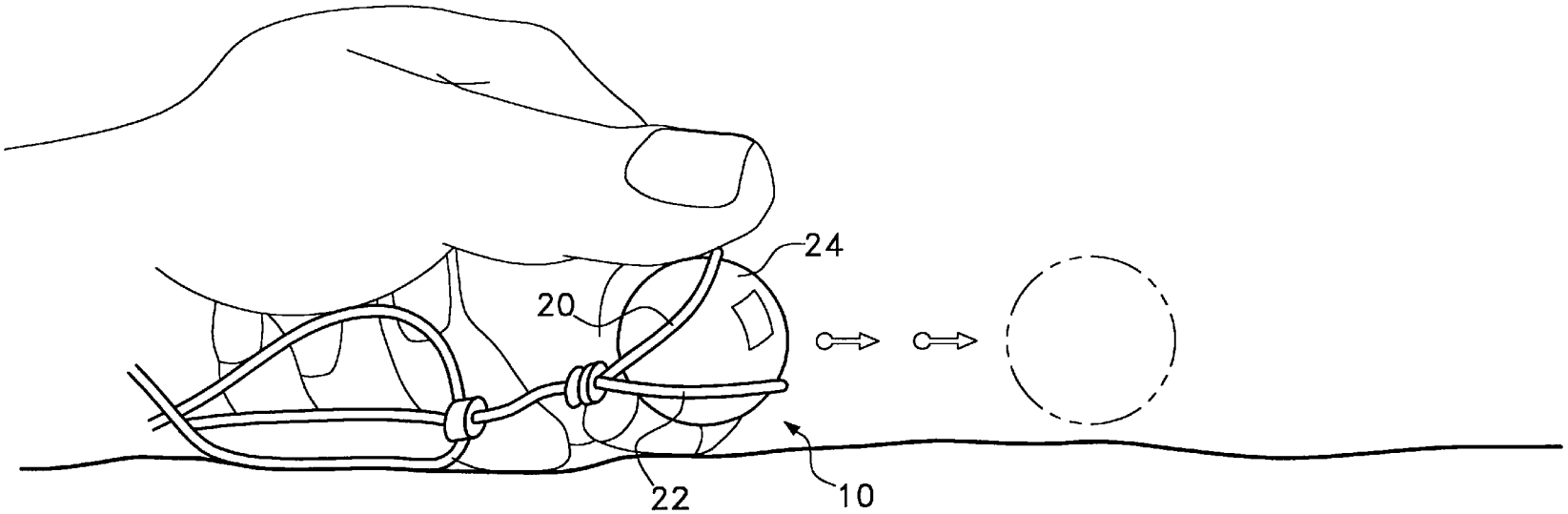
FIG. 2 is view of the embodiment of FIG. 1 being held in a person's hand for use in playing the game of marbles.

Referring now to FIG. 2, it can be seen that the toy FIG. 10 can be folded under a person's hand. A person can then grasp the marble 24, while the marble 24 is still retained within the loop structures 20, 22. A person can then squeeze and shoot the marble 24 in the standard way. The loop structures 20, 22 do not interfere with the grasping and shooting of the marble 24. Rather, the structure of the loops helps a person properly grasp the marble 24 and shoot it in the proper manner. The toy FIG. 10 can therefore be used to retain a marble until the marble is used in the game of marbles. The marble 24 can be shot directly from the toy FIG. 10, without the marble 24 having to be removed first from the loop structures 20, 22 of the marble 24.

Figure 3:
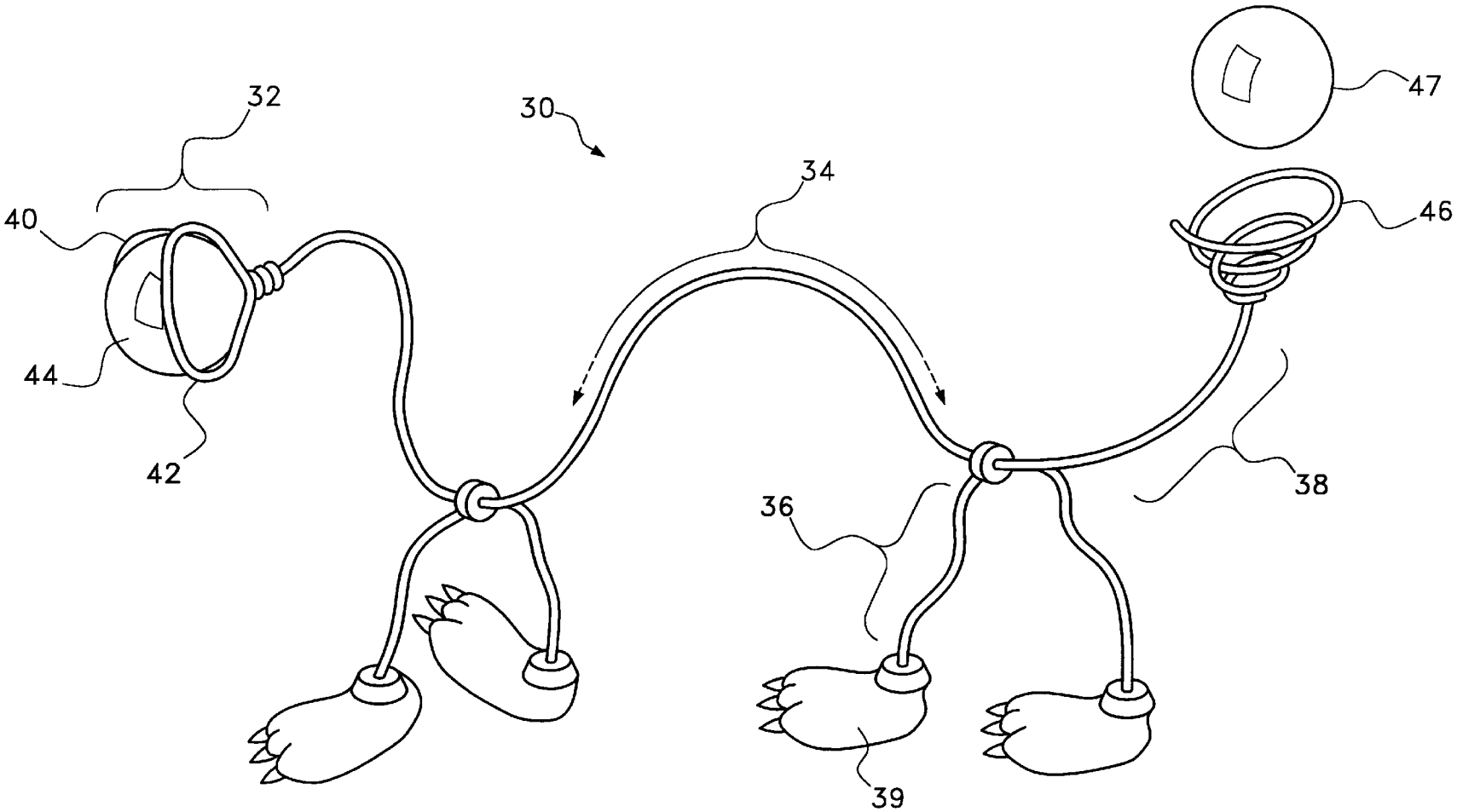
FIG. 3 is a front view of an alternate embodiment of a toy figure in accordance with the present invention.

Referring to FIG. 3, an alternate embodiment of a toy FIG. 30 is shown in accordance with the present invention. The toy FIG. 30 is configured as a dinosaur, rather than the humanoid figure previously described. The toy FIG. 30 has a head section 32, a body section 34, limb sections 36 and a tail section 38. The limb sections 36 terminate with feet 39 so that the toy FIG. 30 is capable of being free standing. The head section 32 of the toy FIG. 30 is comprised of two diverging loop structures 40, 42, as was previously described. The loop structures 40, 42 retain a marble 44 so that the marble 44 appears to be the head of the toy FIG. 30. The marble 44 is retained until it is manually removed from the loop structures 40, 42 or is grasped and shot from the loop structures 40, 42.

On the tail section 38 of the toy FIG. 30, is a tapered helical structure 46. The tapered helical structure 46 is capable of receiving and retaining another marble 47. The second marble 47 can be used to physically balance the toy FIG. 30 or to just preserve a second marble 47 in reserve for when the marble 44 in the loop structures 40, 42 is shot.

Figure 4:
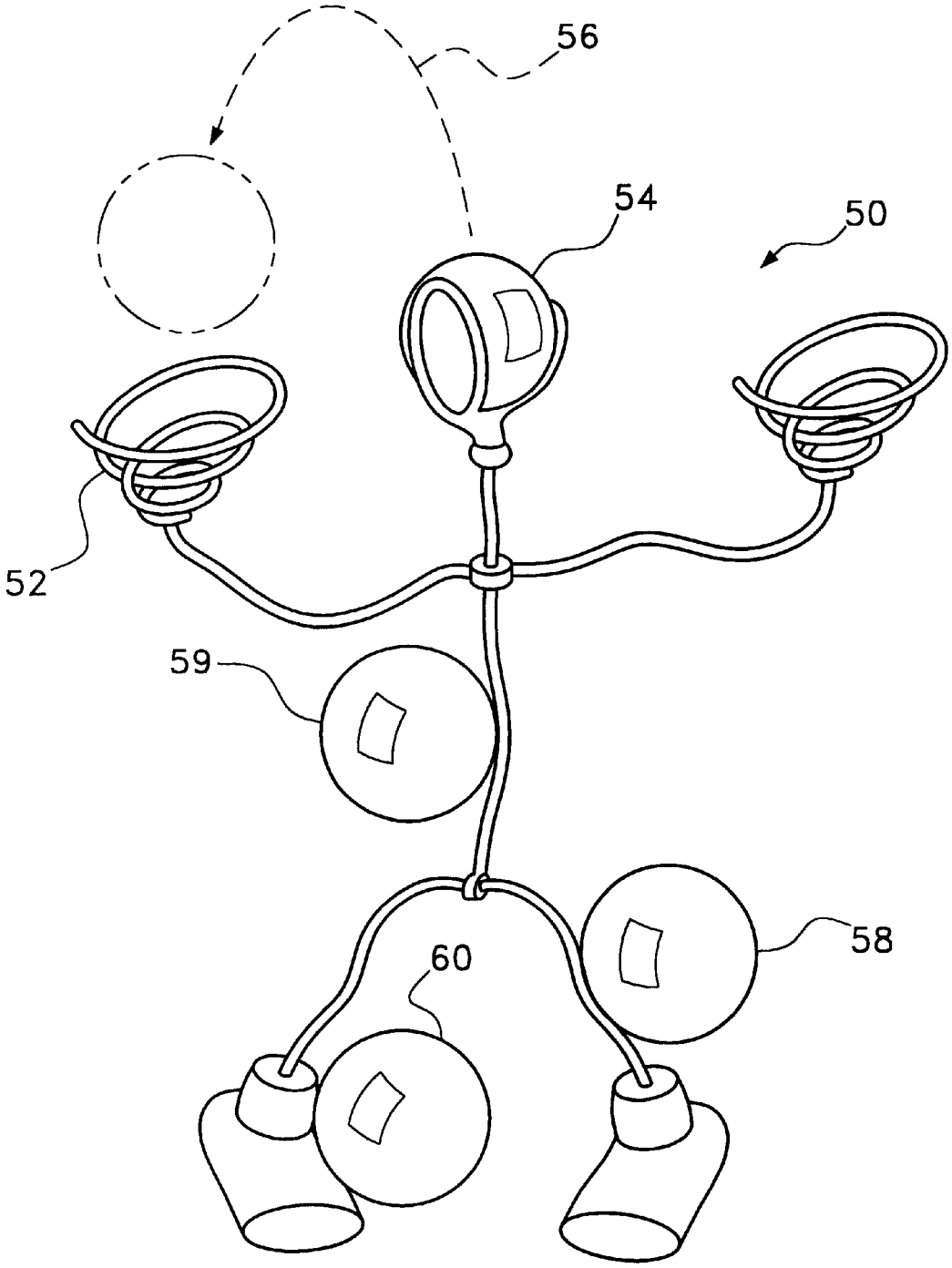
FIG. 4 is a front view of a second alternate embodiment of a toy figure in accordance with the present invention. a toy figure in accordance with the present invention.

Referring to FIG. 4, an alternate embodiment of a FIG. 50 is shown in accordance with the present invention. The figure is a huminoid figure such as that previously described in conjunction with FIG. 1. However, in FIG. 4, the FIG. 50 has hands that are formed as tapered helical structures 52. The tapered helical structure 52 is capable of receiving and retaining a marble 54. The marble 54 can be set in the looped structures at the head of the figure. By squeezing the marble out of the looped structures, the marble can be shot upwardly and caught in one of the tapered helical structures 52, as is indicated by arrow 56.

In the shown embodiment, the marbles 54, 58, 59, 60 shown are not ordinary glass marbles. Rather, the marbles 54, 58, 59, 60 are magnetic or have magnetic cores. As such, the magnets 54, 58, 59, 60 are attracted to any material with ferro-magnetic properties, such as the wire within the FIG. 50 or the magnets contained within the feet of the FIG. 50. By having magnetic marbles and a figure with a ferro-magnetic core material, the marbles 54, 58, 59, 60 will adhere to the FIG. 50. Consequently, the marble 54 at the head of the FIG. 50 is retained both mechanically and with magnetic forces. Similarly, when a marble lands in one of the tapered helical structures 52, the marble will tend to remain in that structure due to magnetic attraction.

In the embodiments previously described, the body and limbs of the toy figures are made primarily of coated wire. Such a construction is merely exemplary. The body and limbs of the toy figures can be molded to anatomically correct or anatomically exaggerated dimensions. The loop structures at the head of the figures is preferably made of coated wire so as to enable the marble to be seen, grasped and shot.

It should also be understood that the shapes of the limbs, hands, feet and tail of the described embodiments are also exemplary. For example, the double loop structure construction previously described as the head sections of the toy figures can also be oriented as the hands or feet of a toy figure. As such, a toy figure can be configured that retains one marble at the head, two marbles at the hands and two additional marbles at the feet.

It will also be understood that the embodiments of the present invention toy figure that are described and illustrated herein are merely exemplary and a person skilled in the art can make many variations to the embodiment shown without departing from the scope of the present invention. All variations, modifications and alternate embodiments to these structures that serve the stated function are intended to be included within the scope of the present invention as defined by the appended claims.

What is claimed is:

1. A toy figure device, comprising:

a body section;

limbs extending from said body section, wherein said limbs are capable of supporting said body section;

a head section supported by said body section, said head section having two loop structures that are configured to retain a marble, so that a majority of the marble remains visible when retained.

2. The device according to claim 1, wherein each of said loop structures extend from said body section at a common point.

3. The device according to claim 2, wherein said loop structures diverge from said common point thereby defining a widening gap between said loop structures.

4. The device according to claim 1, further including a tail section that extend from said body section.

5. The device according to claim 1, wherein at least one of said limbs terminates with a marble retaining structure.

6. The device according to claim 5, wherein said marble retaining structure includes a tapered helical structure.

7. The device according to claim 5, wherein said marble retaining structure includes diverging loop structures capable of retaining a marble therebetween.

8. The device according to claim 1, wherein said body section and said head section are comprised of segments of wire.

9. A toy figure assembly, comprising:

a marble having a predetermined diameter;

a figure having a body section, limb sections and a head section extending from said body section, wherein said head section contains a first loop structure and a second loop structure that receives and retains said marble so as to support said marble in position as a visible part of a head to said figure.

10. The assembly according to claim 9, wherein said first loop structure and said second loop structure that are joined at a common point.

11. The device according to claim 10, wherein said marble has magnetic properties and is magnetically attracted to said figure.

12. The assembly according to claim 9, wherein said first loop structure and said second loop structure symmetrically engage opposite sides of the marble.

13. The assembly according to claim 9, wherein said first loop structure and said second loop structure are equal in size.

14. The assembly according to claim 9, wherein said first loop structure and said second loop structure define openings having diameters smaller than said predetermined diameter of said marble.

15. The assembly according to claim 9, wherein said figure includes limbs and at least one of said limbs terminates with a marble retaining structure.

16. The device according to claim 15, wherein said marble retaining structure includes a tapered helical structure.

17. A toy figure device, comprising:

a body section;

limbs extending from said body section that support said body section, wherein at least one of said limbs terminates with a tapered helical structure that can receive and retain a marble;

a head section supported by said body section, said head section being configured to retain a marble, so that a majority of the marble remains visible when retained.

* * * * *